US006364006B1

(12) United States Patent
Halt et al.

(10) Patent No.: US 6,364,006 B1
(45) Date of Patent: Apr. 2, 2002

(54) BEADED PLATE FOR A HEAT EXCHANGER AND METHOD OF MAKING SAME

(75) Inventors: David Wayne Halt, Milford; David Alvin Starling, Ypsilanti; Ron Richard Semel, Farmington, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/467,694

(22) Filed: Dec. 23, 1999

(51) Int. Cl.[7] ..... F28F 3/04
(52) U.S. Cl. ..... 165/148; 165/916
(58) Field of Search ..... 165/166, 167, 165/916, 148; 29/890.03

(56) References Cited

U.S. PATENT DOCUMENTS

| | | | | | |
|---|---|---|---|---|---|
| 785,580 | A | * | 3/1905 | Shiels et al. | 165/166 |
| 2,526,157 | A | * | 10/1950 | Ramen | 165/166 |
| 3,486,489 | A | | 12/1969 | Huggins | |
| 4,043,388 | A | * | 8/1977 | Zebuhr | 165/166 |
| 4,600,053 | A | * | 7/1986 | Patel et al. | 165/170 |
| 5,036,911 | A | | 8/1991 | So et al. | |
| 5,638,897 | A | | 6/1997 | Hirano et al. | |

FOREIGN PATENT DOCUMENTS

| | | | | | |
|---|---|---|---|---|---|
| DE | 3037873 | | | 3/1982 | |
| FR | 1271705 | | | 12/1963 | |
| GB | 12114 | A | * | 5/1897 | 165/167 |
| GB | 107652 | A | * | 7/1917 | 165/167 |
| GB | 1020045 | A | * | 2/1966 | 165/167 |
| GB | 2223091 | | | 3/1990 | |
| RU | 2000534 | | | 9/1993 | |
| WO | WO-94/28367 | A | * | 12/1994 | 165/167 |

* cited by examiner

*Primary Examiner*—Allen Flanigan
(74) *Attorney, Agent, or Firm*—Brinks Hofer Gilson & Lione

(57) ABSTRACT

A beaded plate and method of making same for a heat exchanger includes a plate having a generally planar first surface and opposed second surface. The beaded plate also a plurality of first beads extending generally perpendicular to the first surface of the plate and a plurality of second beads extending generally perpendicular to the second surface of the plate. The first beads have a generally arcuate end surface and the second beads have a generally planar end surface.

4 Claims, 1 Drawing Sheet

BEADED PLATE FOR A HEAT EXCHANGER AND METHOD OF MAKING SAME

BACKGROUND OF THE INVENTION

1. Field of the Invention

The present invention relates generally to heat exchangers for motor vehicles and, more specifically, to a beaded plate and method of making same for a heat exchanger in a motor vehicle.

2. Description of the Related Art

It is known to provide plates for a heat exchanger such as an oil cooler in a motor vehicle. Typically, opposed plates carry a first fluid medium in contact with an interior thereof while a second fluid medium contacts an exterior thereof. Typically, the first fluid medium is oil and the second fluid medium is water. Where a temperature difference exists between the first and second fluid mediums, heat will be transferred between the two via heat conductive walls of the plates.

It is also known to provide corrugated fins or ribs sandwiched between pairs of plates of a heat exchanger such as an oil cooler that act as a turbulator to increase the oil side heat transfer coefficient while having to accept an appreciable amount of oil side pressure drop. One known method of making such a construction is to physically insert a corrugated fin into the space between the plates after the plates have been manufactured. This is an extremely difficult process since the corrugated fin to be inserted between the plates is extremely thin and subject to deformation during the insertion process.

It is also known to provide beaded plates for a heat exchanger in which beads define a plurality of passageways between the plates for movement of a fluid therethrough to increase the surface area of conductive material available for heat transfer and to cause turbulence or mixing of the fluid carried between the plates. An example of such a heat exchanger is disclosed in U.S. Pat. No. 4,600,053. In this patent, each of the plates has a plurality of beads formed thereon with one plate having one distinct variety of beads and the other plate having another distinct variety of beads. The beads of the plates contact each other and are bonded together to force fluid to flow therearound. The beads are aligned in rows in which one row has an "A" pattern and the adjacent or next row has a "B" pattern in which the beads are aligned with spaces of the A pattern. The rows are repeated in an AB pattern in which the beads in the A rows are aligned longitudinally or downstream with each other and the beads in the B rows are aligned longitudinally or downstream with each other.

Current oil to water in-tank oil coolers require the insertion of a turbulator to enhance oil side heat transfer. These oil coolers require thick material for the plates to meet burst requirements due to minimal contact between the plates on the water side. Examples of such oil to water in-tank oil coolers are disclosed in U.S. Pat. Nos. 5,369,883 and 5,538,077. Both of these patents disclose an in-tank oil cooler with turbulators.

Although the above heat exchangers have worked well, it is desirable to eliminate the use of a turbulator between plates of a heat exchanger. It is also desirable to provide beaded plates for a heat exchanger having a repeating bead pattern stamped into the plate on both the oil and coolant sides to enhance heat transfer. It is further desirable to provide beaded plates for a heat exchanger that allow for thinner material to be used for the plates.

SUMMARY OF THE INVENTION

Accordingly, the present invention is a beaded plate for a heat exchanger including a plate having a generally planar first surface and opposed second surface. The beaded plate also a plurality of first beads extending generally perpendicular to the first surface of the plate and a plurality of second beads extending generally perpendicular to the second surface of the plate. The first beads have a generally arcuate end surface and the second beads have a generally planar end surface.

Also, the present invention is a method of making a beaded plate for a heat exchanger. The method includes the steps of providing a plate having a generally planar first surface and an opposed second surface. The method includes the step of forming a plurality of first beads to extend generally perpendicular to the first surface of the plate with a generally arcuate end surface and a plurality of second beads to extend generally perpendicular to the second surface of the plate with a generally planar end surface.

One advantage of the present invention is that a beaded plate for a heat exchanger such as an oil cooler is provided for a motor vehicle for cooling liquid oil. Another advantage of the present invention is that the beaded plate eliminates the need for a separate turbulator between plates for a heat exchanger such as an in-tank oil cooler. Yet another advantage of the present invention is that the beaded plate has a repeating bead pattern stamped into the plate on both the oil and coolant sides. Still another advantage of the present invention is that the beaded plate has a repeating bead pattern on the oil side that enhances heat transfer and a repeating bead pattern on the coolant side to provide structural integrity and enhance coolant side heat transfer. A further advantage of the present invention is that the beaded plate has beads on the oil side that mate with each other as do the beads on the water side. Yet a further advantage of the present invention is that the beaded plate has a bead pattern that alternates to produce a maximum amount of turbulence or mixing. Still a further advantage of the present invention is that a method of making a beaded plate for an oil cooler is provided which uses less material, parts and complexity for assembly. Another advantage of the present invention is that the beaded plate allows for a thinner material to be used for the plates.

Other features and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
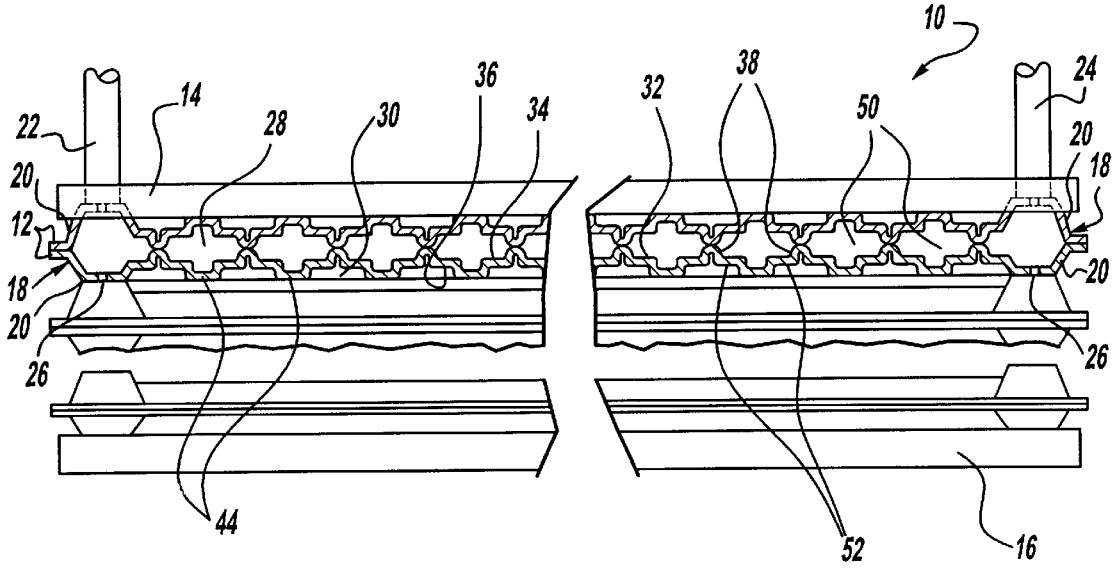
FIG. 1 is a perspective view of a beaded plate, according to the present invention, illustrated in operational relationship with a heat exchanger for a motor vehicle.

Referring to the drawings and in particular FIG. 1, one embodiment of a heat exchanger 10, according to the present invention, such as an oil cooler, evaporator or condenser, is shown for a motor vehicle (not shown). In the embodiment illustrated, the heat exchanger 10 is an in-tank oil cooler. The heat exchanger 10 includes a plurality of generally parallel beaded plates 12, according to the present invention, pairs of which are joined together in a face-to-face relationship to form a stack. The heat exchanger 10 also includes oppositely disposed first and second mounting plates 14 and 16 at ends of the stack. The mounting plates 14, 16 fluidly communicate with flow headers, generally indicated at 18, formed by bosses 20 on each end of the beaded plates 12. The heat exchanger 10 includes a fluid inlet 22 for conducting fluid into the heat exchanger 10 formed in the first mounting plate 14 and a fluid outlet 24 for directing fluid out of the heat exchanger 10 formed in the first mounting plate 14. It should be appreciated that, except for the beaded plates 12, the heat exchanger 10 is conventional and known in the art. It should also be appreciated that the beaded plates 12 could be used for heat exchangers in other applications besides motor vehicles.

Figure 2:
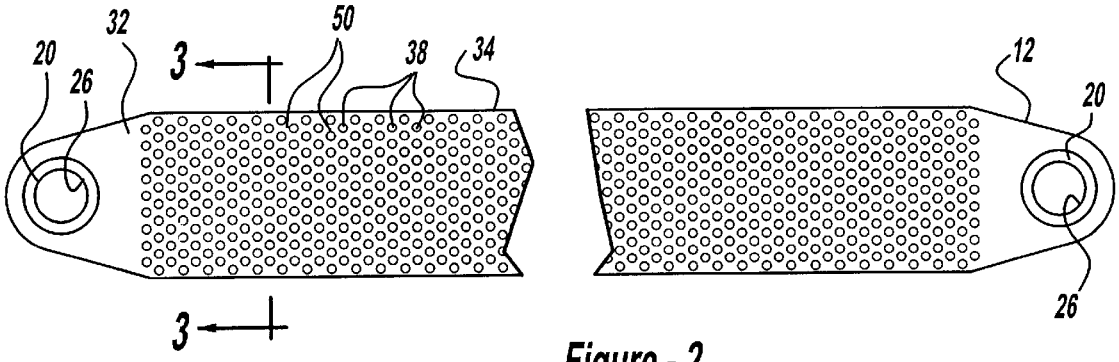
FIG. 2 is a plan view of the beaded plate of FIG. 1.
Figure 3:
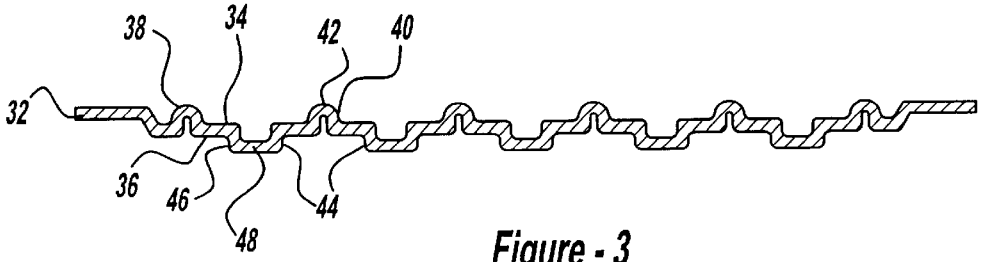
FIG. 3 is a sectional view taken along line 3–3 of FIG. 2.

Referring to FIGS. 1 through 3, the beaded plate 12 extends longitudinally and is substantially planar or flat. The beaded plate 12 includes a raised boss 20 on each end having an aperture 26 extending therethrough. The bosses 20 are stacked together such that the apertures 26 are aligned to form the flow header 18 to allow parallel flow of fluid such as oil through first channels 28 of the beaded plates 12. The beaded plates 12 also allow parallel flow of fluid such as a coolant, preferably water, through second channels 30 of the beaded plates 12. It should be appreciated that flow headers (not shown) and manifolds (not shown) are provided for coolant flow through the second channels 30 of the heat exchanger 10.

The beaded plate 12 includes a wall 32 having a first surface 34 and an opposed second surface 36, both being generally planar and extending longitudinally and laterally. The beaded plate 12 also includes a plurality of first beads 38 extending above and generally perpendicular to a plane of the first surface 34 and spaced laterally from each other. The first beads 38 are generally circular in shape and have a predetermined diameter such as three millimeters. The first beads 38 have a side wall 40 extending from the first surface 34 and terminating in a generally arcuate end wall 42. It should be appreciated that the first beads 38 have a generally inverted U cross-sectional shape.

The beaded plate 12 also includes a plurality of second beads 44 extending below and generally perpendicular to a plane of the second surface 36 and spaced laterally from each other. The second beads 44 are generally circular in shape and have a predetermined diameter such as five millimeters. The second beads 44 have a side wall 46 extending from the second surface 36 and terminating in a generally planar end wall 48. It should be appreciated that the second beads 44 have a generally rectangular cross-sectional shape.

As illustrated in FIGS. 2 and 3, the first beads 38 and second beads 44 are formed in a pattern of a plurality of rows, preferably two rows A,B in the pattern, which is repeated. Each row A,B contains a plurality of, preferably a predetermined number of first beads 38 in a range of two to eleven and second beads 44 in a range of two to seven. The rows A,B of first beads 38 are spaced longitudinally on the first side 34 a predetermined distance and the second beads 44 are spaced longitudinally on the second side 36 a predetermined distance. The pattern is repeated in the streamwise or longitudinal direction. It should be appreciated that a row A,B could contain all full beads or full and half beads. It should also be appreciated that the beads 38 and 44 allow the beaded plates 12 to be stacked together and, when stacked, the beads 38 and 44 align on both the oil and water sides of the beaded plates 12.

The beaded plate 12 is made of a metal material such as aluminum or an alloy thereof and has a cladding on its first surface 34 and second surface 38 for brazing. In the embodiment illustrated, the beaded plates 12 are arranged such that the end walls 42 of the first beads 38 contact each other to form a plurality of flow passages 50 in the first channel 28 and the end walls 48 of the second beads 44 contact each other to form a plurality of flow passages 52 in the second channel 30 as illustrated in FIG. 1. The first beads 38 turbulate fluid flow through the first channel 28 and the second beads 44 turbulate fluid flow through the second channel 30. It should be appreciated that the end walls 42 and 48 of the first beads 38 and second beads 44, respectively, are brazed to each other. It should also be appreciated that the entire heat exchanger 10 is brazed together as is known in the art.

Referring to FIGS. 1 through 3, a method of making the beaded plate 12, according to the present invention, is shown. The method includes the step of providing a plate 12 having a generally planar first surface 34 and an opposed second surface 36. The method includes the step of forming a plurality of first beads 38 to extend above the first surface 34 of the plate 12 and a plurality of second beads 44 to extend below the second surface 36 of the plate 12 in a repeating pattern within a plurality of rows A,B. The step of forming is carried out by stamping the first beads 38 and second beads 44 in the plate 12 by conventional stamping processes.

Also, a method of making the heat exchanger 10, according to the present invention, is shown. The method includes the step of contacting first and second beaded plates 12 with each other to form a first channel 28 therebetween and contact opposed first beads 38 with each other to form the fluid flow passages 50 as illustrated in FIG. 1. The method includes the step of brazing a pair of the beaded plates 12 by heating the beaded plates 12 to a predetermined temperature to melt the brazing material to braze the bosses 20 and the first beads 38 of the beaded plates 12 together. The pair of joined beaded plates 12 is then cooled to solidify the molten braze material to secure the bosses 20 together and the first beads 38 together. The method includes the step of contacting another pair of the joined plates 12 to the first pair of joined plates 12 to form a second channel 30 therebetween and contact opposed second beads 44 with each other to form the fluid flow passages 52 as illustrated in FIG. 1. The method includes the step of brazing a stack of the joined plates 12 by heating the plates 12 to a predetermined temperature to melt the brazing material to braze the bosses 20 and the second beads 44 of the beaded plates 12 together. The stack of joined beaded plates 12 is then cooled to solidify the molten braze material to secure the bosses 20 together and the second beads 44 together. The method includes the steps of connecting the first and second mounting plates 14 and 16 to the brazed beaded plates 12 to form the heat exchanger 10.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A beaded plate for a heat exchanger comprising:

a plate having a generally planar first surface and opposed second surface; and a plurality of first beads extending from said first surface of said plate and a plurality of second beads extending from and generally perpendicular to said second surface of said plate, wherein said first beads have a generally arcuate end surface and said second beads have a generally planar end surface, and wherein said second beads have a generally rectangular shaped cross-section and are integrally formed with said plate.

2. A heat exchanger comprising:

a plurality of generally parallel plates being joined together in a face-to-face relationship to provide a first channel on one side and a second channel on another side, said plates being joined together and aligned in a stack; and said plates including a plurality of first beads spaced laterally and opposing each other in said first channel and a plurality of second beads spaced laterally and opposing each other in said second channel, wherein said first beads have a generally arcuate end surface contacting each other to form first turbulators and said second beads have a generally planar end surface contacting each other to form second turbulators, and wherein said second beads have a generally rectangular shaped cross-section and are integrally formed with said plate.

3. The heat exchanger of claim 2, wherein said first turbulators are adapted to turbulate oil and said second turbulators are adapted to turbulate water.

4. A method of making a beaded plate for a heat exchanger comprising the steps of:

providing a plate having a generally planar first surface and an opposed second surface; and stamping a plurality of first beads to extend from the first surface of the plate with a generally arcuate end surface and a plurality of second beads to extend from and generally perpendicular to the second surface of the plate with a generally planar end surface and a generally rectangular cross-section.

* * * * *